US006102244A

United States Patent [19]

Kuwano et al.

[11] Patent Number: 6,102,244

[45] Date of Patent: Aug. 15, 2000

[54] MUG WITH MULTIPLE SIP HOLES AND LID GASKET

[75] Inventors: Toshiaki Kuwano; Yasuhiro Murakami, both of Oxford, Miss.

[73] Assignee: The Thermos Company, Batesville, Miss.

[21] Appl. No.: 09/421,731

[22] Filed: Oct. 20, 1999

[51] Int. Cl.[7] ..... A47G 19/22

[52] U.S. Cl. ..... 220/713; 220/711; 220/254

[58] Field of Search ..... 220/711, 713, 220/714, 254; 222/482

[56] References Cited

U.S. PATENT DOCUMENTS

| | | | |
|---|---|---|---|
| 3,338,467 | 8/1967 | Albert | 220/714 |
| 4,238,045 | 12/1980 | D'Andria | 220/254 X |
| 5,456,380 | 10/1995 | Ito et al. | 220/713 |
| 5,890,619 | 4/1999 | Belanger | 220/713 |

*Primary Examiner*—Steven Pollard

*Attorney, Agent, or Firm*—Wood, Phillips, VanSanten, Clark & Mortimer

[57] ABSTRACT

A travel mug includes a vessel 10 defined by two shells 14, 16 nested within one another and spaced from each other to define an insulating space 18. Both have open upper ends 20, 22 that are joined in an annular upper end joint 24. An annular shoulder gasket 26 is located on the joint 24 and an annular shoulder 30 is mounted on one of the shells 14, 16 to cover the shoulder gasket 26. The shoulder has a radially inwardly directed gross sealing surface 40 near a lower edge as well as a radially inner thread 42. A lid 12 is removably threaded on the shoulder 30 and has an annular side wall 56 merging with a bottom wall 52 having an imperforate center 52. An array of sip holes 66 is located at the point 58 of merger of the walls 52, 56, and are aligned with the gross sealing surface 40 to be closed thereby when the lid 12 is fully threaded into the vessel 10. An annular lid gasket 74 is located on the side wall 56 of the lid above the sip holes and sealingly engages the shoulder 30 above the gross sealing surface 40.

7 Claims, 4 Drawing Sheets

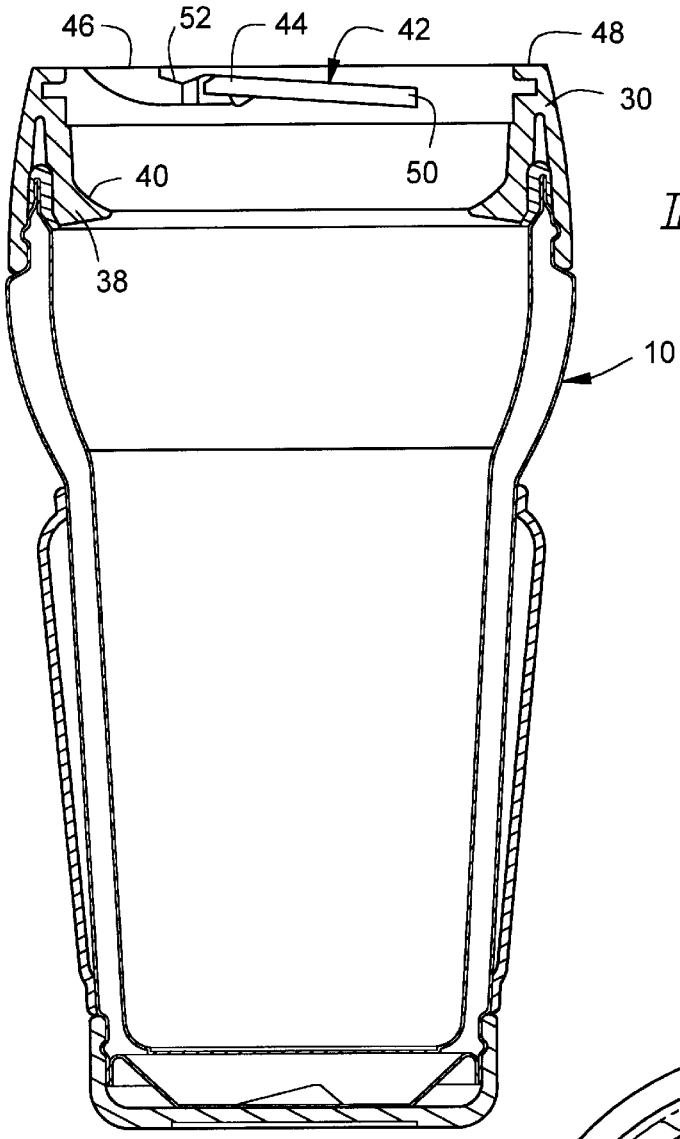
FIG. 4
FIG. 5
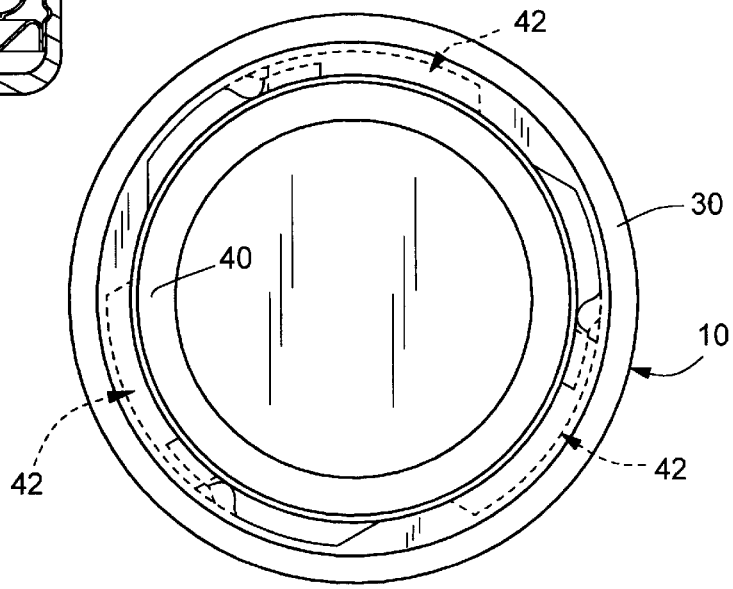

MUG WITH MULTIPLE SIP HOLES AND LID GASKET

FIELD OF THE INVENTION

This invention relates to mugs, and more particularly, to mugs in the popular form known as "travel mugs".

BACKGROUND OF THE INVENTION

While mugs of various sorts have been used for centuries, the last decade or two has seen a phenomenal increase in the popularity of so-called "travel mugs".

A typical travel mug includes an open-topped vessel which is capped with a lid. The lid is removable to allow a beverage to be placed within the vessel and typically has one sip hole along with a diametrically opposite vent hole. With the lid in place, the beverage may be consumed by tipping the vessel such that the beverage flows out of the sip hole into the mouth of the user. Ambient air enters the mug through the vent hole to replace the volume of the beverage consumed by the user.

These mugs are quite popular in that the presence of the lid prevents the beverage from sloshing out of the vessel as spillage. Further, the lids are normally designed so that the sip holes are at a lower most point in a recess in the upper surface of the lid so that any beverage that inadvertently escapes the vessel will normally be received within the recess of the lid and drain back into the vessel. As a consequence of this type of construction, travel mugs are ideally suited for use by pedestrians as well as occupants of a vehicle. Sloshing beverage as a result of the up and down and/or side-to-side movements of a walking pedestrian is captivated by the lid as is sloshing of the vessel contents as a result of movement of a vehicle.

Such vessels are not without certain drawbacks and/or irritations in use. For example, the presence of but a single sip hole makes it imperative that mug be oriented by the user so that the sip hole is at the lower most edge of the lid. If this is not done, it is possible that the beverage will not be dispensed from the vessel or, when dispensed, may start its flow suddenly and cause spillage on the user.

Another difficulty encountered with many travel mugs is the fact that the lid may become loose, allowing leakage between the lid and the vessel, again to the surprise of the user. In extreme cases, the lid may even become detached from the vessel which quite clearly is highly undesirable when one is attempting to dispense a beverage from the vessel.

The present invention is directed to overcoming one or more of the above problems.

SUMMARY OF THE INVENTION

It is the principal object of the invention to provide a new and improved travel mug. More particularly, it is an object of the invention to provide a new and improved travel mug that is easier to use and which is less subject to inadvertent spillage.

According to one facet of the invention, a travel mug is provided that includes a vessel defined by a shell and having a circular, open upper end. An annular shoulder is mounted on the shell upper end and has a radially inwardly directed gross sealing surface near a lower edge of the shoulder at a radially inner thread located above the lower edge. A lid is removably disposed on and within the shoulder. The lid has an annular side wall with a radially outer thread engageable with the radially inner thread, and a bottom wall with an imperforate center which merges with the side wall. The lid further includes an annular array of sip holes located generally at the location where the side and bottom walls merge. The sip holes are aligned with the gross sealing surface to be closed thereby when the lid is fully threaded within the shoulder and to be open with respect to the sealing surface when the lid is not threaded fully within the shoulder. A lid gasket is located on the lid side wall above the sip holes and sealingly engages the shoulder above the gross sealing surface, at least when the sip holes are open. As a consequence of this construction, inadvertent leakage is minimized by the lid gasket.

In a preferred embodiment of the invention, the gross sealing surface is shaped as an inverted frusto cone and the location at which the side and bottom walls merge is shaped as a frusto cone to mate with the inverted frusto cone.

Preferably, the annular side wall and the imperforate bottom wall merge by means of generally radially extending, spaced spokes with the spaces between the spokes defining the sip holes.

According to another facet of the invention, a mug generally as described above has its radially inner thread defined by a plurality of at least two, equally angularly spaced notches in the shoulder. Each notch has a first end opening in an upper surface of the shoulder and a closed second end located between the upper surface and the lower edge of the shoulder. A downwardly directed detent is disposed between the first and second ends. The radially outer thread comprises at least two equally angularly spaced radially directed tabs on the side wall and sized to be removably received in respective ones of the notches.

When the lid is threaded to the shoulder, the downwardly directed detents prevent the lid from being unthreaded by acting as an obstruction to movement of the tabs to the notch. As a consequence, inadvertent disassociation of the lid from the shoulder is avoided.

In a highly preferred embodiment, the vessel is defined by two shells with one nested within the other and generally spaced from each other to define an insulating space. Both of the shells have circular open ends and are joined to each other at an annular upper end joint. An annular shoulder gasket of relatively soft sealing material is on the upper ends and covers the joint. The annular shoulder is made of relatively hard material and is mounted on one of the shells and covers the shoulder gasket.

Other objects and advantages will become apparent from the following specification taken in connection with the accompanying drawings.

BRIEF DESCRIPTION OF THE DRAWINGS

FIG. 4 is a view similar to FIG. 1 but with the lid of the mug removed;

FIG. 5 is a plan view of the mug;

DESCRIPTION OF THE PREFERRED EMBODIMENT

Figure 1:
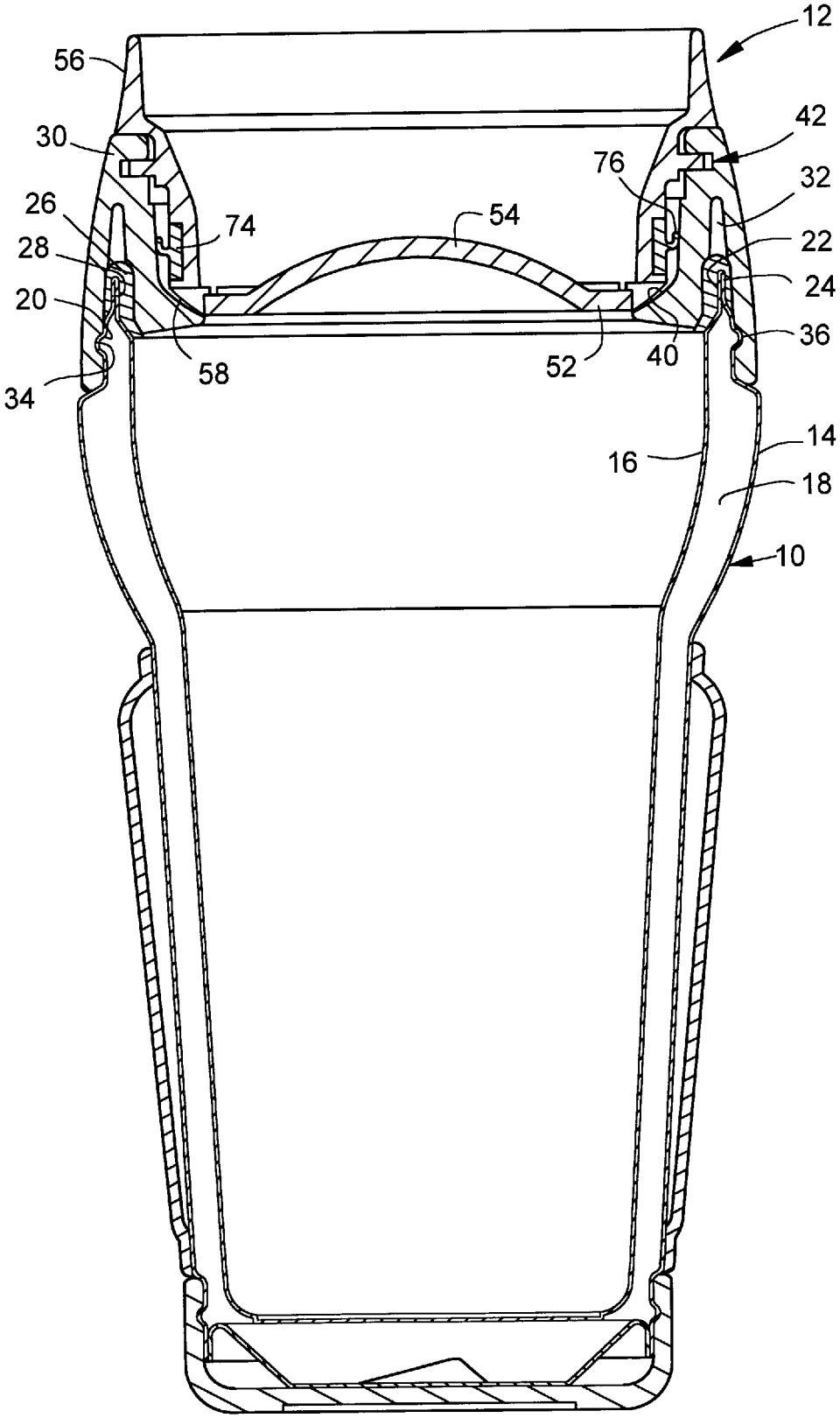
FIG. 1 is a vertical section of a travel mug made according to the invention.

An exemplary embodiment of a travel mug made according to the invention is illustrated in the drawings and with reference to FIG. 1 is seen to include a vessel, generally designated 10 and a lid, generally designated 12. The vessel 10 is made up of two shells 14 and 16 with the shell 16 nested within the shell 14 in spaced relation thereto so as to define an insulating space 18. In the usual case, the insulating space 18 will be evacuated by a process known in the art.

The shells 14 and 16 both have circular upper openings defined by ends 20 and 22 respectively whereat the same are joined by an annular, peripheral joint 24 formed by brazing or the like. A shell gasket 26 of an annular configuration is disposed about the joint 24. The gasket 26 is of a relatively soft, elastomeric material as is well known and has a downwardly opening, interior groove 28 receiving the upper ends 20, 22 of the shells 14, 16.

Also included is an annular shoulder component 30 which is made of relatively hard material, typically plastic. The shoulder 30 includes a downwardly opening groove 32 which receives the shell gasket 26. On one side, the shoulder includes a radially inwardly opening peripheral groove 34 which receives a radially outwardly directed peripheral bead 36 on the outer shell 14 in interference relation so as to mount the shoulder 30 on the vessel 10. As best seen in FIG. 4, near its lower edge, the shoulder 30 includes a radially inward directed, annular projection 38 whose upper surface 40 is in the form of an inverted frusto cone. As will be seen, the surface 40 acts as a gross sealing surface for the lid 12 under conditions to be described. The shoulder 30 also includes a radially inner thread, generally designated 42. The thread 42 is in the form of three, equally angularly spaced notches 44. Each notch 44 has an open end 46 which opens to an upper surface 48 of the shoulder 30. Each notch 44 also includes a closed, lower end 50, which is located between the upper surface 48 of the shoulder 30 and the gross sealing surface 40 thereon.

Intermediate the ends 46, 50 of each notch 44 is a downwardly directed detent 52 for purposes to be seen.

Figure 2:
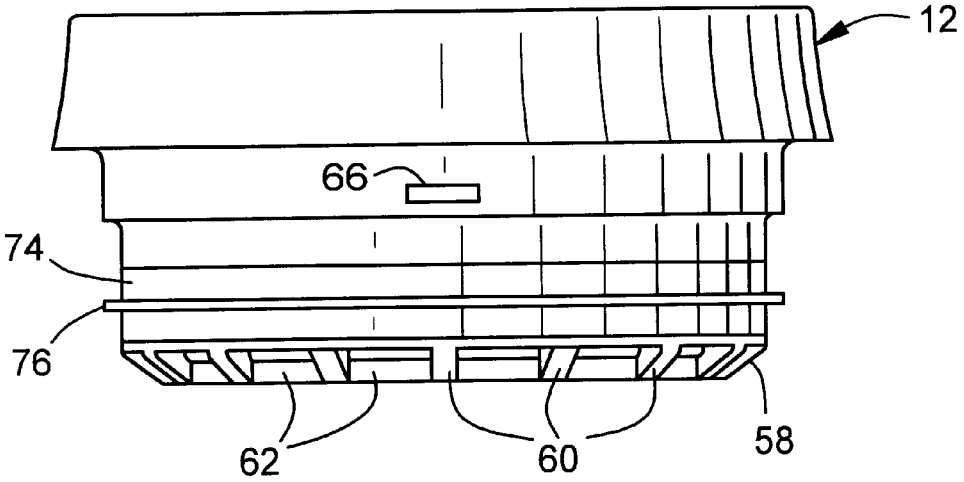
FIG. 2 is a side elevation of a lid used with the mug.
Figure 3:
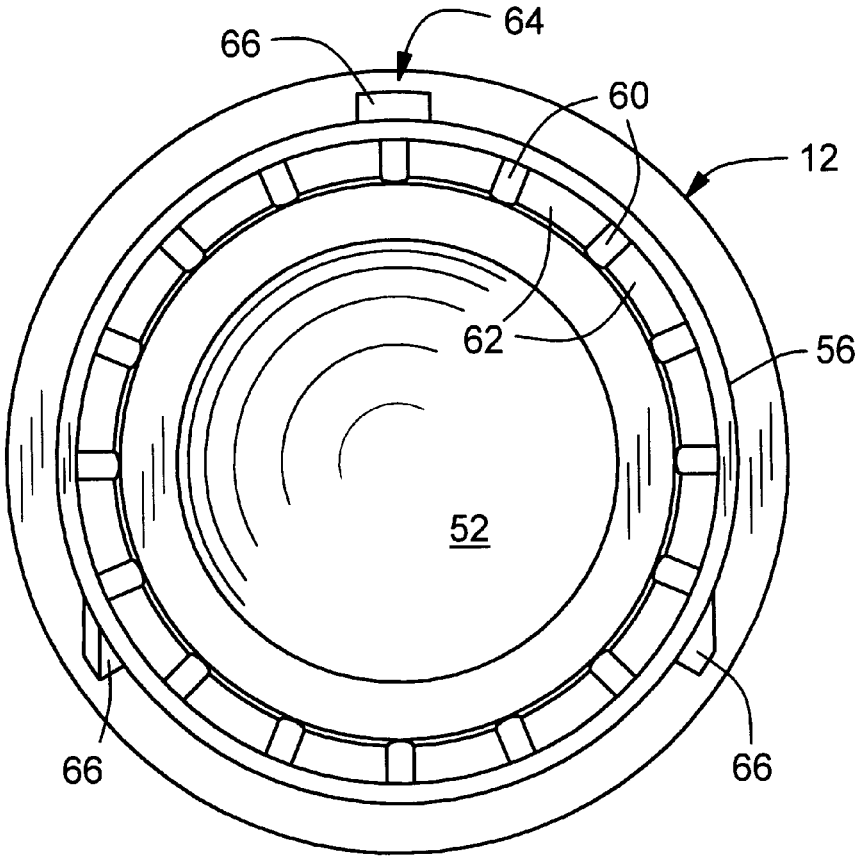
FIG. 3 is a bottom plan view of the lid.

Turning now to FIGS. 1–3, inclusive, the lid 12 will be described in greater detail. The lid 12 includes a bottom wall 52 having an imperforate center 54 which merges with an annular side wall 56 at a location 58 that overlies the gross sealing surface 40. At the location 58, the lid 12 is shaped as a frusto cone configured to mate with the inverted frusto cone shaped gross sealing surface 40. As seen in FIGS. 2 and 3, at the location 58, a plurality of radially extending spokes 60, which are spaced from one another, interconnect the bottom 52 of the lid 12 with the annular side wall 56. Spaces 62 between the spokes define sip holes through which a beverage may exit the vessel 10 and through which air may enter to replace exiting beverage. The sip holes are in an annular array which is to say that they extend completely about the bottom wall 52 as best seen in FIG. 3. The sip holes 62 are also aligned with the gross sealing surface 40 so as to be closed thereby when the lid 12 is fully threaded within the vessel 10 and to be open to allow the egress of beverage when the lid 12 is in any other relation to the vessel 10.

Figure 6:
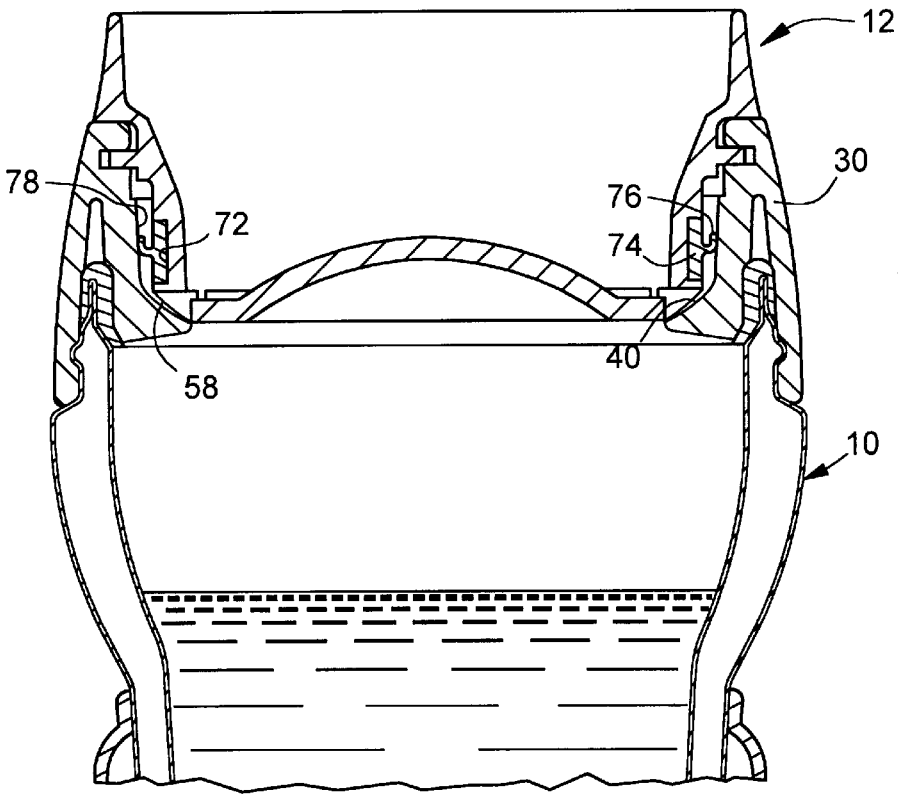
FIG. 6 is a fragmentary, vertical section showing the lid in a closed position on the mug.

More specifically, intermediate its top and bottom, the lid 12 is provided with a radially outer thread, generally designated 64, in the form of three equally angularly spaced tabs 66. The tabs 66 may have the configurations illustrated in FIG. 3 and are arranged to be disposed in the notch 44 via entry through the open end 46 (FIG. 4). By twisting the lid 12 within the notches 44, the tabs 66 may be brought into contact with the closed end 50 of each notch 44. In this configuration, the lid 12 is fully threaded into the vessel 10 and the sip holes 62 will be closed by reason of their abutment with the gross sealing surface 40. On the other hand, when it is desired to open the sip holes 62, the lid 12 may be rotated on the shoulder 30 until the tabs 66 abut the detents 52 in the notch 44. In this configuration, because the notch 44 slopes downwardly from the detent 52 to the closed end 50 as best seen in FIG. 4, the frusto conical shape at the location 58 of the lid 12 will be spaced from the gross sealing surface 40 as viewed in FIG. 7 so that a beverage may exit the vessel as schematically illustrated by an arrow 70. The previously described closed position is illustrated in FIG. 6. In this case, the frusto conical surface 58 of the lid 12 is abutting the gross sealing surface 40 so as to essentially seal off the interior of the vessel 10 from the exterior thereof. The degree of sealing achieved at the interface of the elements 40 and 58 will, of course, depend upon the relative hardness of both the shoulder 30 and the lid 12.

Figure 7:
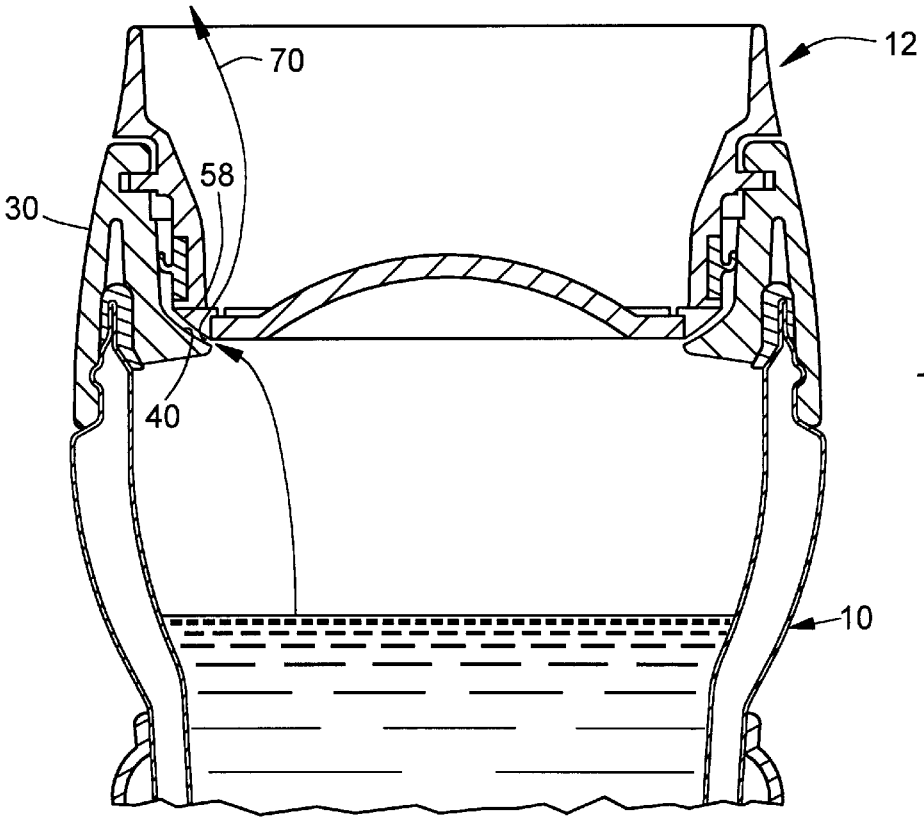
FIG. 7 is a view similar to FIG. 6 but showing the lid in a position to allow beverage within the vessel to exit via the sip holes.

To assure that there cannot be inadvertent leakage between the shoulder 30 and the lid 12, particularly when the lid 12 is in the open position as illustrated in FIG. 7, just above the frusto conical surface 58 at the location, the lid 12 includes a radially outwardly opening peripheral groove 72. An annular seal 74 is disposed in the groove 72 and includes a radially outwardly directed peripheral finger 76 as best seen in FIG. 2. The finger 76 seals against the radially inner wall 78 of the shoulder 30 thereby preventing any fluid within the vessel 10 from egressing the same when the vessel 10 is tipped through the interface between the lid 12 and the vessel 10.

As a consequence of the foregoing construction, it will be readily appreciated that the lid seal 74 and the sealing finger 76 prevent inadvertent spillage when the lid 12 is not tightly on the vessel 10. It will also be appreciated that use of the threads 42, 64, in connection with the presence of the detents 52 in the notches 44 defining the thread 42, prevents inadvertent disassociation of the lid 12 from the vessel 10. Again, spillage potential is reduced.

Finally, it will be observed that the presence of the sip holes 62 around the entire periphery of the lid 12 allow the mug to be used easily without having to concern onself with the orientation of a single sip hole with respect to the mouth of the user.

What is claimed is:

1. A mug comprising:

a vessel defined by two shells with one nested within the other and generally spaced therefrom to define an insulating space, both said shells having circular, open upper ends and being joined to each other at an annular upper end joint;

an annular shoulder gasket of relatively soft sealing material on said upper ends and covering said joint;

an annular shoulder of relatively hard material mounted on one of said shells and covering said shoulder gasket, said shoulder having a radially inwardly directed gross sealing surface near a lower edge of said shoulder and a radially inner thread located above said lower edge;

a lid removably disposed on and within said shoulder, said lid having an annular side wall with a radially outer thread engageable with said radially inner thread and a bottom wall with an imperforate center and merging with said side wall, said lid further including an annular array of sip holes located generally at the location where said side and bottom walls merge, said sip holes being aligned with said gross sealing surface to be closed thereby when said lid is threaded fully within said shoulder and to be open with respect to said sealing surface when said lid is not threaded fully within said shoulder; and a lid gasket on said lid side wall above said sip holes and sealingly engaging said shoulder above said gross sealing surface at least when said sip holes are open.

2. The method of claim 1 wherein said gross sealing surface is shaped as an inverted frusto cone and said location is shaped as a frusto cone to note with said inverted frusto cone.

3. The method of claim 1 wherein said annular side wall and said imperforate bottom wall merge by means of generally radially extending spaces, spokes, the spaces between said spokes defining said sip holes.

4. The method of claim 1 wherein said radially inner thread includes a plurality of at least two equally angularly spaced notches in said shoulder, each notch having a first end opening in an upper surface of said shoulder, a closed second end located between said upper surface and said lower edge of said shoulder, and a downwardly directed detent between said first and second ends; and said radially outer thread comprises at least two equally angular spaced radially directed tabs on said side wall and sized to be removably received in respective ones of said notches.

5. A mug comprising:

a vessel defined by a shell and having a circular, open upper end;

an annular shoulder mounted on said shell, said shoulder having a radially inwardly directed gross sealing surface near a lower edge of said shoulder and a radially inner thread located above said lower edge;

a lid removably disposed on and within said shoulder, said lid having an annular side wall with a radially outer thread engageable with said radially inner thread and a bottom wall with an imperforate center and merging with said side wall, said lid further including an annular array of sip holes located generally at the location where said side and bottom walls merge, said sip holes being aligned with said gross sealing surface to be closed thereby when said lid is threaded fully within said shoulder and to be open with respect to said sealing surface when said lid is not threaded fully within said shoulder; and a lid gasket on said lid side wall above said sip holes and sealingly engaging said shoulder above said gross sealing surface at least when said sip holes are open.

6. A mug comprising:

a vessel defined by two shells with one nested within the other and generally spaced therefrom to define an insulating space, both said shells having circular, open upper ends and being joined to each other at an annular upper end joint;

an annular shoulder gasket of relatively soft sealing material on said upper ends and covering said joint;

an annular shoulder of relatively hard material mounted on one of said shells and covering said shoulder gasket, said shoulder having a radially inwardly directed gross sealing surface shaped as an inverted frusto cone near a lower edge of said shoulder and a radially inner thread located above said lower edge and including a plurality of at least two equally angularly spaced notches in said shoulder, each notch having a first end opening in an upper surface of said shoulder, a closed second end located between said upper surface and said lower edge of said shoulder, and a downwardly directed detent between said first and second ends;

a lid removably disposed on and within said shoulder, said lid having an annular side wall with a radially outer thread engageable with said radially inner thread and a bottom wall with an imperforate center and merging with said side wall in a frusto conical shape size to mate with said inverted frusto cone, said lid further including an annular array of sip holes located generally at the location where said side and bottom walls merge, said sip holes being defined by spaces between a plurality of radially extending spokes interconnecting said side and bottom walls and aligned with said gross sealing surface to be closed thereby when said lid is threaded fully within said shoulder and to be open with respect to said sealing surface when said lid is not threaded fully within said shoulder; and a lid gasket on said lid side wall above said sip holes and sealingly engaging said shoulder above said gross sealing surface at least when said sip holes are open.

7. A mug comprising:

a vessel defined by a shell and having a circular, open upper end;

an annular shoulder mounted on said shell, said shoulder having a radially inwardly directed gross sealing surface shaped as an inverted frusto cone near a lower edge of said shoulder and a radially inner thread located above said lower edge and including a plurality of at least two equally angularly spaced notches in said shoulder, each notch having a first end opening in an upper surface of said shoulder, a closed second end located between said upper surface and said lower edge of said shoulder, and a downwardly directed detent between said first and second ends;

a lid removably disposed on and within said shoulder, said lid having an annular side wall with a radially outer thread engageable with said radially inner thread and a bottom wall with an imperforate center and merging with said side wall in a frusto conical shape size to mate with said inverted frusto cone, said lid further including an annular array of sip holes located generally at the location where said side and bottom walls merge, said sip holes being defined by spaces between a plurality of radially extending spokes interconnecting said side and bottom walls and aligned with said gross sealing surface to be closed thereby when said lid is threaded fully within said shoulder and to be open with respect to said sealing surface when said lid is not threaded fully within said shoulder; and a lid gasket on said lid side wall above said sip holes and sealingly engaging said shoulder above said gross sealing surface at least when said sip holes are open.

* * * * *